US009637146B2

(12) United States Patent
Ueda et al.

(10) Patent No.: US 9,637,146 B2
(45) Date of Patent: May 2, 2017

(54) COUPLER SYSTEM AND RAILCAR

(71) Applicant: KAWASAKI JUKOGYO KABUSHIKI KAISHA, Kobe-shi, Hyogo (JP)

(72) Inventors: Toru Ueda, Kobe (JP); Hisataka Tamaki, Kobe (JP); Kouichi Tsunoda, Kobe (JP); Hiroki Kusakabe, Kobe (JP); Yoshiyuki Andou, Kobe (JP); Yoshikazu Ogura, Kobe (JP); Naoki Wada, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 14/892,076

(22) PCT Filed: May 20, 2014

(86) PCT No.: PCT/JP2014/002649

§ 371 (c)(1),
(2) Date: Nov. 18, 2015

(87) PCT Pub. No.: WO2014/188712

PCT Pub. Date: Nov. 27, 2014

(65) Prior Publication Data

US 2016/0090110 A1 Mar. 31, 2016

(30) Foreign Application Priority Data

May 22, 2013 (JP) ..... 2013-107839

(51) Int. Cl.
*B61G 5/02* (2006.01)
*B61G 7/12* (2006.01)
(Continued)

(52) U.S. Cl.
CPC ..... *B61G 5/02* (2013.01); *B61F 3/00* (2013.01); *B61F 5/42* (2013.01); *B61G 7/12* (2013.01)

(58) Field of Classification Search
CPC ... B61G 5/00; B61G 5/02; B61G 7/12; B61G 7/00; B61G 7/08; B61G 7/10; B61G 7/14; B61F 5/38; B61F 5/42
(Continued)

(56) References Cited

U.S. PATENT DOCUMENTS 3,520,421 A 7/1970 Gutridge
3,547,045 A * 12/1970 Cunningham ..... B61F 5/08 105/199.1

(Continued)

FOREIGN PATENT DOCUMENTS

JP S52-94603 U 7/1977
JP S57-167864 U 10/1982

(Continued)

*Primary Examiner* — Mark Le
(74) *Attorney, Agent, or Firm* — Oliff PLC

(57) ABSTRACT

A coupler system includes: a coupler main body attached to a longitudinal direction end of a carbody of a railcar so as to be rotatable in a yaw direction; a curvature information acquiring portion configured to acquire curvature information of a track, the railcar being located on the track; a control portion configured to determine a target rotation angle of the coupler main body in accordance with the acquired curvature information and output a rotation signal regarding the determined target rotation angle; and a rotation angle changing portion configured to rotate the coupler main body to the target rotation angle based on the output rotation signal. When the railcar is stopped or when the railcar is traveling at a coupling speed, the control portion outputs the rotation signal to start rotating the coupler main body.

8 Claims, 2 Drawing Sheets

(51) Int. Cl.
*B61F 5/42* (2006.01)
*B61F 3/00* (2006.01)

(58) Field of Classification Search
USPC ..... 105/200, 168
See application file for complete search history.

(56) References Cited

U.S. PATENT DOCUMENTS

| | | | | |
|---|---|---|---|---|
| 3,642,149 | A | 2/1972 | Chierici | |
| 5,429,056 | A * | 7/1995 | Pees | B61F 5/386 105/168 |
| 2003/0116519 | A1 | 6/2003 | Radewagen et al. | |
| 2012/0118195 | A1 * | 5/2012 | Creighton | B61D 7/00 105/377.06 |
| 2014/0284297 | A1 * | 9/2014 | Peckham | B61G 5/08 213/75 R |

FOREIGN PATENT DOCUMENTS

| | | | |
|---|---|---|---|
| JP | 2011-011653 | A | 1/2011 |
| JP | 2011-213244 | A | 10/2011 |

* cited by examiner

COUPLER SYSTEM AND RAILCAR

TECHNICAL FIELD

The present invention relates to a coupler system of a railcar and the railcar including the coupler system, and particularly to a coupler system and a railcar each of which can easily realize coupling on a curved track.

BACKGROUND ART

Generally, a coupler is provided at each of end portions of a railcar. The coupler transfers tractive force and compressive force between railcars. Conventionally, when coupling the railcars to each other on a curved track, the directions and positions of adjacent couplers deviate from each other, so that the couplers need to be rotated by a worker or the like in a yaw direction (car width direction) in accordance with curvature of the track and are then coupled to each other. PTL 1 proposes a mechanism in a new transportation system car including rubber tires, the mechanism causing a coupler main body to rotate leftward or rightward interlockingly with steerage of a steering mechanism. PTL 1 explains that the railcars can be automatically coupled to each other by the above configuration even when the railcars are located on the curved track.

CITATION LIST

Patent Literature

PTL 1: Japanese Laid-Open Patent Application Publication No. 2011-11653

SUMMARY OF INVENTION

Technical Problem

Regarding a coupler described in PTL 1, the coupler main body and a bogie of the new transportation system car are fixed to each other through a link arm. Therefore, force is directly applied to the bogie from a railcar to be coupled, and this may significantly influence traveling performance, such as rotational resistance of the bogie of the new transportation system car and a derailment coefficient of the new transportation system car. Therefore, when the coupler described in PTL 1 is adopted to an iron wheel type railcar, problems may occur, that is, for example, squeal generated by friction between the wheel and a rail increases. Further, according to the coupler described in PTL 1, the coupler main body rotates in the car width direction every time the railcar travels through the curved track. Therefore, respective parts may be worn away, for example. On this account, a maintenance cost increases.

The present invention was made in view of the above circumstances, and an object of the present invention is to provide a coupler system which can automatically perform coupling even when railcars are located on a curved track and which influences traveling performance of the railcar little.

Solution to Problem

A coupler system according to one aspect of the present invention includes: a coupler main body attached to a longitudinal direction end of a carbody of a railcar so as to be rotatable in a yaw direction (car width direction); a curvature information acquiring portion configured to acquire curvature information of a track, the railcar being located on the track; a control portion configured to determine a target rotation angle of the coupler main body in accordance with the acquired curvature information and output a rotation signal regarding the determined target rotation angle; and a rotation angle changing portion configured to rotate the coupler main body to the target rotation angle based on the output rotation signal, when the railcar is stopped or when the railcar is traveling at a coupling speed, the control portion outputting the rotation signal to start rotating the coupler main body.

According to this configuration, the coupler main body is rotated in accordance with the curvature information of the track, the railcar being located on the track. Therefore, the coupler main body can be set to an appropriate rotation angle. As a result, the railcars can be automatically coupled to each other. According to the above configuration, force applied to the railcar from an adjacent railcar is not directly transferred to the bogie but is transferred through the carbody to the bogie. Therefore, influences on the traveling performance of the railcar can be suppressed.

Advantageous Effects of Invention

As above, the coupler system can automatically perform coupling even when the railcar is located on the curved track, and can suppress influences on the traveling performance of the railcar.

DESCRIPTION OF EMBODIMENTS

Hereinafter, one embodiment of a coupler system will be explained in reference to the drawings. In the following explanations and drawings, the same reference signs are used for the same or corresponding components, and a repetition of the same explanation is avoided.

Embodiment 1

First, Embodiment 1 will be explained.

Entire Configuration of Coupler System

Figure 1:
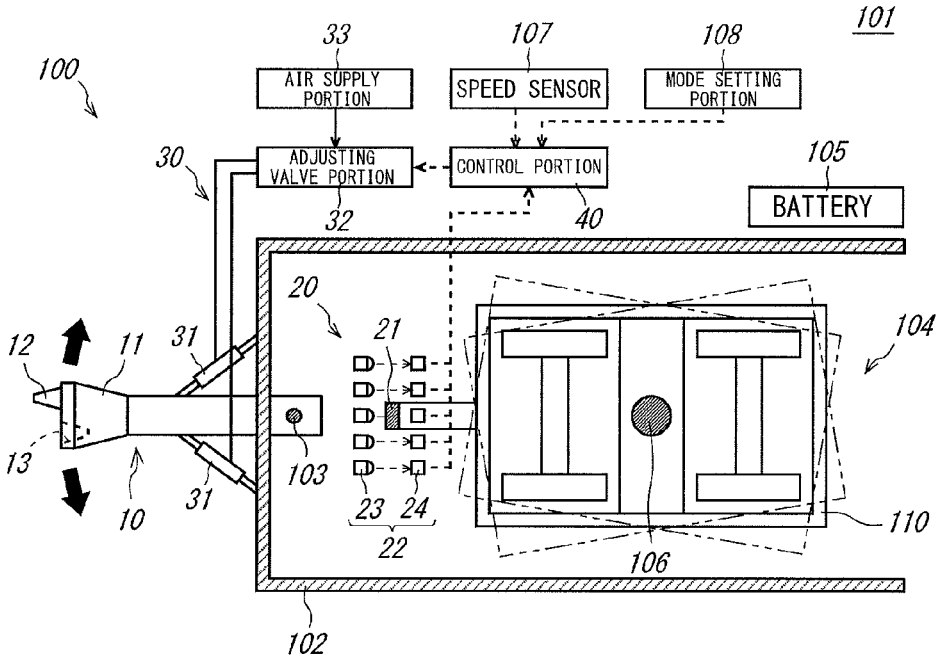
FIG. 1 is a diagram showing an entire coupler system.

First, the configuration of an entire coupler system 100 will be explained. FIG. 1 is a diagram showing the entire coupler system 100. A leftward/rightward direction in FIG. 1 corresponds to a longitudinal direction of a railcar 101, and an upward/downward direction in FIG. 1 corresponds to a car width direction of the railcar 101. For convenience sake, a left side in FIG. 1 is referred to as a "front side" in the following explanation. The coupler system 100 is a system for coupling the railcars 101 to each other. The coupler system 100 includes a coupler main body 10, a curvature information acquiring portion 20, a rotation angle changing portion 30, and a control portion 40. Hereinafter, these components will be explained in order.

The coupler main body 10 is provided at a longitudinal direction end of a carbody 102. When coupling the railcar 101 to another adjacent railcar, the coupler main body 10 of the railcar 101 is coupled to another coupler main body 10 of the adjacent railcar. Specifically, a support shaft member 103 extending in a vertical direction (direction perpendicular to a paper surface of FIG. 1) is provided at a tip end portion of an underframe of the carbody 102, and a base end portion of the coupler main body 10 is supported by the support shaft member 103. With this, the coupler main body 10 can rotate in a yaw direction (car width direction) of the railcar 101. The coupler main body 10 includes a coupling mechanism 11 located at a tip end portion of the coupler main body 10. With this, the coupler main bodies 10 can be coupled to each other.

The configuration of the coupling mechanism 11 is not especially limited. The coupling mechanism 11 of the present embodiment includes an insertion projection 12 and an insertion hole 13. When coupling the railcars to each other, the insertion projection 12 of the coupling mechanism 11 of the railcar 101 is inserted into the insertion hole 13 of the coupling mechanism 11 of the adjacent railcar. The insertion projection 12 has a tapered shape. Therefore, even if central axes of the coupler main bodies 10 to be coupled slightly deviate from each other, the central axes of the coupler main bodies 10 coincide with each other in a process of inserting the insertion projection 12 into the insertion hole 13 as long as a tip end of the insertion projection 12 can be inserted into the insertion hole 13. A range of the central axis deviation which can be corrected as above by the coupler main body 10 is referred to as an "automatic aligning range".

The curvature information acquiring portion 20 acquires curvature information of the track on which the railcar 101 is located. Here, the "curvature information" denotes information regarding the shape of the curved track (i.e., for example, a curved direction of the curved track), such as the radius, curvature, and the like of the curved track. The curvature information acquiring portion 20 of the present embodiment detects a relative rotation angle between the carbody 102 and a bogie frame 110 of a bogie 104 to acquire the curvature information of the track on which the railcar 101 is located. The carbody 102 is supported by the bogie frame 110 so as to be rotatable. The relative rotation angle between the carbody 102 and the bogie frame 110 changes in accordance with the curvature of the track on which the railcar 101 is located. Therefore, by detecting the relative rotation angle between the carbody 102 and the bogie frame 110, the curvature information of the track on which the railcar 101 is located can be acquired. The bogie 104 of the present embodiment may be a bolsterless bogie by which the bogie frame 110 and the carbody 102 are coupled to each other by air springs or a bogie including a bolster as in Embodiment 2.

The curvature information acquiring portion 20 includes a plate-shaped or rod-shaped index member 21 and a plurality of optical axis sensors 22. The index member 21 is provided at a front side of the bogie frame 110 and extends in the vertical direction. The optical axis sensors 22 are attached to a lower surface of the carbody 102 so as to be lined up in the car width direction. Each of the optical axis sensors 22 is constituted by a light emitting portion 23 which emits light in the car longitudinal direction and a light receiving portion 24 which receives the light emitted from the light emitting portion 23. The index member 21 moves between a group of the light emitting portions 23 of the optical axis sensors 22 and a group of the light receiving portions 24 of the optical axis sensors 22 in accordance with the rotation of the bogie frame 110. Therefore, by detecting the optical axis sensor 22 whose light is shielded by the index member 21 (i.e., by detecting a position of the index member 21 as a detected portion relative to the optical axis sensors 22 as a detecting portion), the relative rotation angle between the carbody 102 and the bogie frame 110 can be detected. Normally, the carbody 102 is supported by two bogies 104 that are front and rear bogies. When acquiring the curvature information, only the relative rotation angle between the carbody 102 and the bogie frame 110 of the bogie 104 located close to the coupler main body 10 may be detected, or both the relative rotation angle between the carbody 102 and the bogie frame 110 of the front bogie 104 and the relative rotation angle between the carbody 102 and the bogie frame 110 of the rear bogie 104 may be detected. Electric power is supplied to the optical axis sensors 22 from a battery 105 mounted on the railcar 101.

In the present embodiment, the relative rotation angle between the bogie frame 110 and the carbody 102 is detected by a transmission photoelectronic sensor. However, a reflection photoelectronic sensor may be used. A detection method is not limited to the above. Further, a detecting device is not limited to the photoelectronic sensor. The curvature information containing the rotation angle may be acquired by using various devices, such as an ultrasonic sensor, a magnetic sensor, and an image pickup apparatus. The foregoing has explained a case where the index member 21 as the detected portion is provided at the bogie frame 110, and the optical axis sensors 22 as the detecting portion are provided at the carbody 102. However, the detected portion may be provided at the carbody 102, and the detecting portion may be provided at the bogie frame 110.

As another configuration that detects the relative rotation angle between the carbody 102 and the bogie frame 110, for example, a potentiometer may be provided at a center pin 106 of the bogie 104 supporting the carbody 102. Further, the curvature information acquiring portion 20 does not have to be a portion which detects the relative rotation angle between the carbody 102 and the bogie frame 110. For example, based on track image information acquired by a camera provided at a driver's cab, the curvature information acquiring portion 20 may acquire the curvature information of the track on which the railcar 101 is located. Based on current position information of the railcar 101 and prestored curvature data of all the tracks, the curvature information acquiring portion 20 may acquire the curvature information of the track on which the railcar 101 is located. The curvature data of all the tracks may be stored in the railcar 101 or in a server outside the railcar, and may be acquired by a communication means such as wireless communication. The current position information of the railcar 101 is acquired from, for example, a landside spot signal and a travel distance that is based on the number of revolutions of the wheel of the railcar 101. However, the current position may be acquired by a method other than the above.

The rotation angle changing portion 30 rotates the coupler main body 10. The rotation angle changing portion 30 of the present embodiment includes a pair of air cylinders 31 and a valve adjusting portion 32. Each of the air cylinders 31 connects the coupler main body 10 to the carbody 102. The valve adjusting portion 32 adjusts the amount of air supplied to each of the air cylinders 31. Compressed air is supplied from an air supply portion 33 to the valve adjusting portion 32, and the valve adjusting portion 32 adjusts the amount of compressed air supplied to each of the air cylinders 31 based on a below-described control signal (rotation signal). The air cylinders 31 are arranged at both respective car width direction sides of the coupler main body 10. Each of the air cylinders 31 expands or contracts in accordance with the amount of compressed air supplied from the valve adjusting portion 32. For example, when the compressed air is supplied to the air cylinder 31 arranged at a left side of the coupler main body 10 (i.e., at a lower side in FIG. 1), the air cylinder 31 at the left side expands, so that the coupler main body 10 can be rotated toward the right side (i.e., toward an upper side in FIG. 1). Electric power is supplied to the valve adjusting portion 32 from the battery 105 mounted on the railcar 101.

The rotation angle changing portion 30 rotates the coupler main body 10 by using the air cylinders 31. Therefore, by removing the air from both the air cylinders 31, the coupler main body 10 can be set to a free state. The rotation angle changing portion 30 of the present embodiment rotates the coupler main body 10 by two air cylinders 31 arranged at the respective car width direction sides of the coupler main body 10. However, the rotation angle changing portion 30 may be configured such that: one air cylinder 31 is arranged at one of the car width direction sides of the coupler main body 10; and the coupler main body 10 is rotated by the air cylinder 31. The rotation angle changing portion 30 may be configured to rotate the coupler main body 10 by three or more air cylinders 31. Further, the rotation angle changing portion 30 does not have to include the air cylinders 31 and may include a mechanical actuator or a hydraulic actuator. Furthermore, the rotation angle changing portion 30 may be configured such that: a stepping motor supports a base end portion of the coupler main body 10; and the coupler main body 10 is rotated by the rotation of the stepping motor.

The control portion 40 causes the rotation angle changing portion 30 to rotate the coupler main body 10. The control portion 40 is constituted by a CPU, a ROM, a RAM, a relay, and the like and is electrically connected to a speed sensor 107, a mode setting portion 108, and the optical axis sensors 22 of the curvature information acquiring portion 20. Based on input signals from these devices, the control portion 40 acquires various pieces of information, such as the speed of the railcar 101, a driving mode, the curvature (hereinafter referred to as a "track curvature") of the track on which the railcar 101 is located. The control portion 40 performs calculations based on the input signals from the above devices to control the rotation angle changing portion 30. The control portion 40 is electrically connected to the valve adjusting portion 32 of the rotation angle changing portion 30 and transmits (outputs) the control signal (rotation signal) to the valve adjusting portion 32. Electric power is supplied to the control portion 40 from the battery 105 mounted on the railcar 101.

The above "driving mode" will be briefly explained. The driving mode can be selected by an operation in the driver's cab. The driving mode may be a traveling mode, a coupling mode, or the like. The coupling mode is a mode selected when coupling the railcar 101 to the adjacent railcar. When the coupling mode is selected, the railcar 101 travels at a predetermined coupling speed. The coupling speed is a speed at which the railcar 101 approaches to the adjacent railcar when performing coupling work. For example, the coupling speed is set to not more than 3 km/h (hereinafter may be simply referred to as the "coupling speed"). Even if the coupling mode cannot be selected, the railcar 101 can be coupled to the adjacent railcar by causing the railcar 101 to travel at the coupling speed by a normal driving operation.

Control of Coupler System

Figure 2:
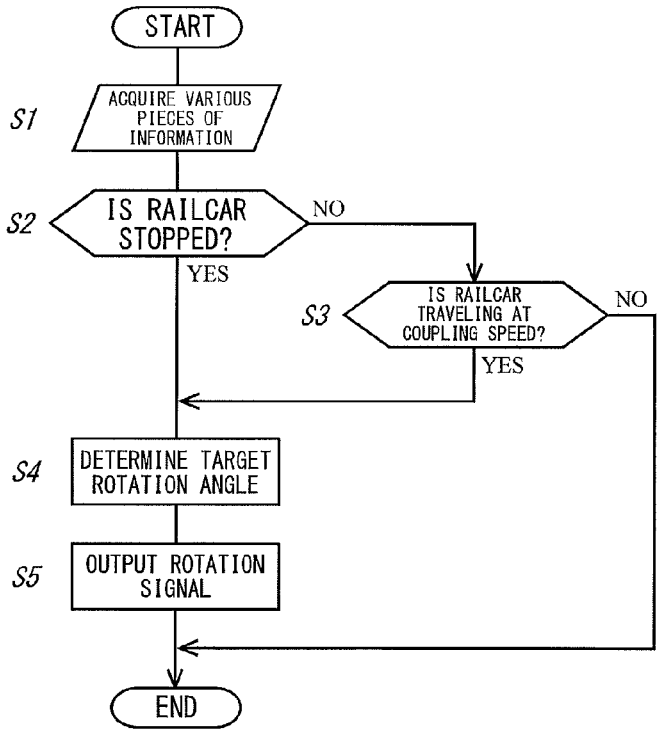
FIG. 2 is a flow chart showing control steps of the coupler system.

Next, the control of the coupler system 100 will be explained in reference to FIG. 2. FIG. 2 is a flow chart showing control steps of the coupler system 100. The control steps shown in FIG. 2 are executed by the control portion 40.

First, the control portion 40 acquires various pieces of information (Step S1). Specifically, the control portion 40 acquires the speed of the railcar 101 based on the input signal from the speed sensor 107, acquires the driving mode based on the input signal from the mode setting portion 108, and acquires the track curvature based on the input signal from the curvature information acquiring portion 20.

Next, the control portion 40 determines whether or not the railcar 101 is stopped (Step S2). To be specific, the control portion 40 determines whether or not the speed of the railcar 101 is zero. When the control portion 40 determines that the railcar 101 is stopped (Yes in Step S2), the process proceeds to Step S4. In contrast, when the control portion 40 determines that the railcar 101 is not stopped (No in Step S2), the process proceeds to Step S3.

Next, when the control portion 40 determines that the railcar 101 is not stopped, the control portion 40 determines whether or not the railcar 101 is traveling at the coupling speed (Step S3). In the present embodiment, when the driving mode is the coupling mode, the control portion 40 determines that the railcar 101 is traveling at the coupling speed. It should be noted that whether or not the railcar 101 is traveling at the coupling speed may be determined based on the actually measured speed of the railcar 101. When the control portion 40 determines that the railcar 101 is traveling at the coupling speed (Yes in Step S3), the process proceeds to Step S4. When the control portion 40 determines that the railcar 101 is not traveling at the coupling speed, that is, when the control portion 40 determines that the railcar 101 is traveling at a speed other than the coupling speed (No in Step S3), the control portion 40 terminates the control.

Next, in Step S4, the control portion 40 determines a target rotation angle. The target rotation angle is a value corresponding to the track curvature and is prestored in the control portion 40 for each track curvature. To realize appropriate coupling on not only the simple curved track but also an S-shaped track, a transition curve track, or the like, the target rotation angle is appropriately set such that the deviation of the central axis of the coupler main body 10 to be coupled falls within the above-described "automatic aligning range".

As described above, a specific value of the target rotation angle to be stored is set in consideration of the track on which the railcar is planned to travel, the configuration of the coupler main body 10, and the like. At least when the railcar 101 is on the track which curves to the right, the coupler main body 10 is rotated to the right, and when the railcar 101 is on the track which curves to the left, the coupler main body 10 is rotated to the left. As the curvature of the track on which the railcar 101 is located increases, the rotation angle of the coupler main body 10 increases.

Next, the control portion 40 transmits to the rotation angle changing portion 30 (valve adjusting portion 32) the control signal corresponding to the target rotation angle determined in Step S4 (Step S5). With this, based on the rotation signal output from the control portion 40, the rotation angle changing portion 30 rotates the coupler main body 10 to the target rotation angle. As above, according to the present embodiment, when coupling the railcar 101, the coupler main body 10 is rotated to the rotation angle appropriate for the coupling work. In other words, when not coupling the railcar 101, that is, when the railcar 101 is traveling at a normal operating speed, the coupler main body 10 is not rotated every time the railcar 101 travels through the curved line. Therefore, the traveling performance is not influenced, and wear of various parts and the like can be suppressed.

The control of the coupler system 100 is not limited to the above. For example, in the control of the coupler system 100, any one of Steps S2 and S3 may be omitted. To be specific, the coupler system 100 does not have to rotate the coupler main body 10 both when the railcar 101 is stopped and when the railcar 101 is traveling at the coupling speed. The coupler system 100 may rotate the coupler main body 10 only when the railcar 101 is stopped, or the coupler system 100 may rotate the coupler main body 10 only when the railcar 101 is traveling at the coupling speed. To be specific, when the railcar 101 is stopped or is traveling at the coupling speed, the control portion 40 may output the rotation signal and start rotating the coupler main body 10.

Operations in Coupling Work

Next, the operations of the railcar 101 and the coupler system 100 in the coupling work of the railcar 101 will be explained. The following will explain a case where the railcar 101 which is stopped by failure is coupled to a railcar for rescue (hereinafter simply referred to as a "rescue railcar") and is moved by traction or propulsion. Each of the failed railcar 101 and the rescue railcar includes the coupler system 100.

First, if the railcar 101 is stopped on the curved track by failure, the control portion 40 of the failed railcar 101 determines that the railcar 101 is stopped. Then, the control portion 40 of the failed railcar 101 causes the rotation angle changing portion 30 to rotate the coupler main body 10 to the target rotation angle. The case where the railcar 101 is stopped by failure may be a case where the electric power cannot be collected from an overhead contact line because of some reasons. Even in such a case, the curvature information acquiring portion 20 and the control portion 40 can receive the electric power from the battery 105, and the valve adjusting portion 32 can receive the electric power from the battery 105. Thus, the amount of air supplied to each of the air cylinders 31 can be adjusted. As a result, the coupler main body 10 is rotated to the target rotation angle. Therefore, even when the electric power is not supplied from the overhead contact line, the coupler main body 10 can be surely rotated.

Next, when the rescue railcar stops near the failed railcar 101, the control portion 40 of the rescue railcar detects the stop and causes the rotation angle changing portion 30 to rotate the coupler main body 10 to the target rotation angle. After that, when the coupling mode is selected as the driving mode of the rescue railcar, the rescue railcar travels at the coupling speed toward the failed railcar 101 while maintaining the control of the rotation angle of the coupler main body 10, the rotation angle being set when the rescue railcar is in a stop state. Then, the rescue railcar and the railcar 101 are coupled to each other in a state where each of the coupler main bodies 10 is set to the optimal target rotation angle.

As above, since the coupler main body 10 of the railcar 101 is rotated to the target rotation angle, the deviation of the central axis of the coupler main body 10 of the railcar 101 falls within the automatic aligning range. In this state, by further moving the rescue railcar toward the failed railcar 101, the central axes of the coupler main bodies 10 finally coincide with each other, so that the coupler main bodies 10 of the railcars 101 are coupled to each other. Therefore, according to the present embodiment, the railcars can be automatically coupled to each other without a crew or a worker getting out of the railcar. After the coupler main bodies 10 are coupled to each other, the air is removed from the air cylinders 31 of the rotation angle changing portion 30, so that the coupler main body 10 becomes the free state.

Embodiment 2

Next, Embodiment 2 will be explained. In Embodiment 2, the bogie 104 includes a bolster, and the curvature information acquiring portion 20 is different in configuration from the curvature information acquiring portion 20 of Embodiment 1. Other than the above, Embodiment 1 and Embodiment 2 are basically the same as each other. Hereinafter, the configurations of the bogie 104 and the curvature information acquiring portion 20 according to the present embodiment will be explained.

Figure 3:
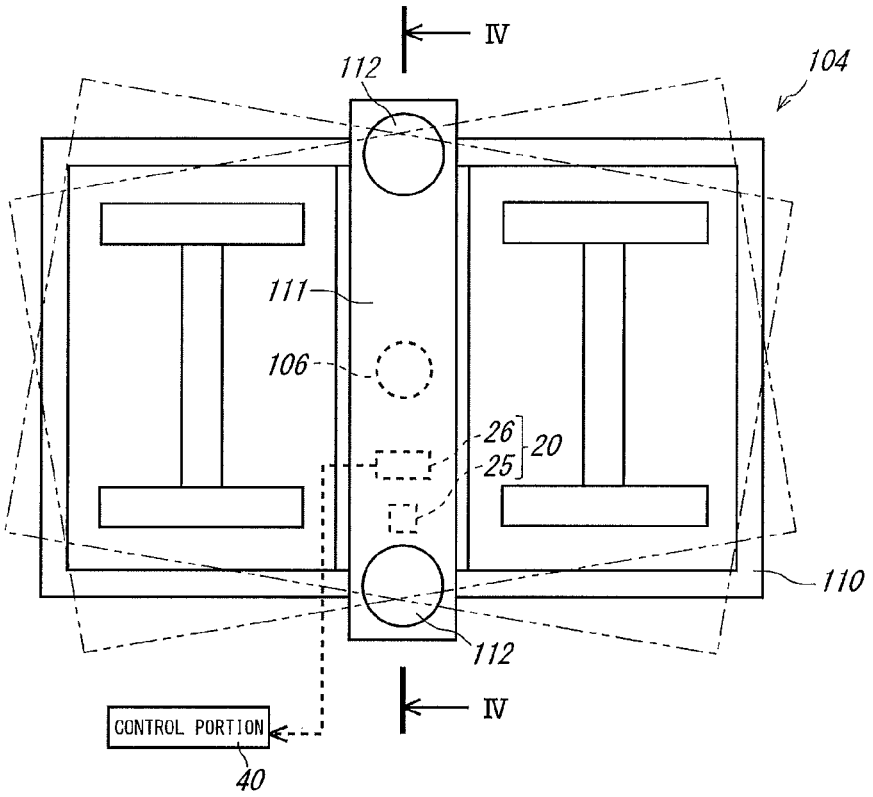
FIG. 3 is a schematic plan view of a bogie according to another embodiment.
Figure 4:
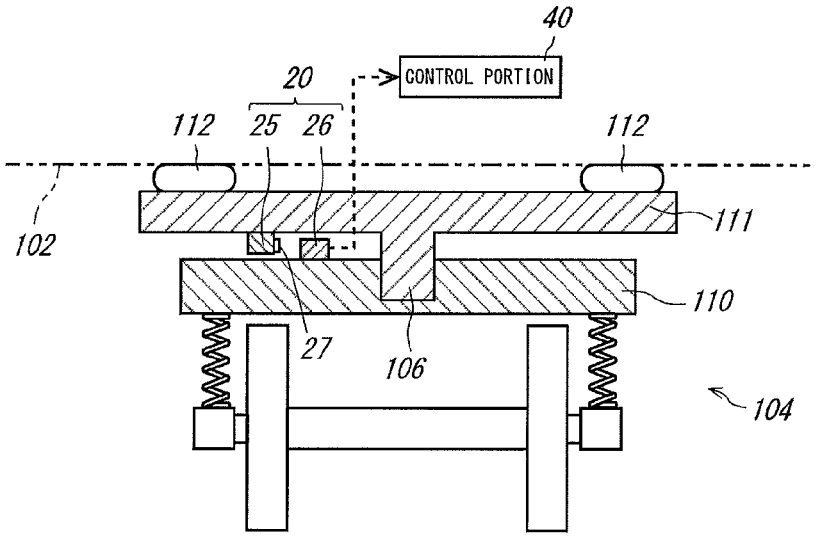
FIG. 4 is a schematic cross-sectional view taken along line IV-IV of FIG. 3.

FIG. 3 is a schematic plan view of the bogie 104 of the present embodiment. FIG. 4 is a schematic cross-sectional view taken along line IV-IV of FIG. 3. As shown in FIG. 4, the bogie 104 of the present embodiment is a bogie including a bolster adopting a so-called direct mount system. The bogie 104 includes the bogie frame 110 and a bolster beam 111 supporting the bogie frame 110. The carbody 102 is supported by the bolster beam 111 via air springs 112. The bolster beam 111 is supported by the bogie frame 110 so as to be rotatable around the center pin 106. Therefore, the bolster beam 111 operates interlockingly with the carbody 102 (i.e., the bolster beam 111 rotates integrally with or substantially integrally with the carbody 102). When the bogie frame 110 rotates relative to the carbody 102, the bogie frame 110 also rotates relative to the bolster beam 111. To be specific, if a relative rotation angle between the bolster beam 111 and the bogie frame 110 can be detected, the relative rotation angle between the carbody 102 and the bogie frame 110 can be acquired, and therefore, the curvature information of the track on which the railcar 101 is located can be acquired.

The curvature information acquiring portion 20 of the present embodiment includes an index member 25 and a magnetic sensor 26. The index member 25 is provided on a lower surface of the bolster beam 111. The magnetic sensor 26 is provided on an upper surface of the bogie frame 110 so as to oppose the index member 25. A magnetic tape 27 is attached to a surface of the index member 25, the surface opposing the magnetic sensor 26. The magnetic sensor 26 detects a magnetic field generated by the magnetic tape 27, that is, the magnetic sensor 26 detects a position of the index member 25 that is the detected portion relative to the magnetic sensor 26 that is the detecting portion. With this, the relative rotation angle between the bolster beam 111 and the bogie frame 110 can be acquired, and therefore, the relative rotation angle between the carbody 102 and the bogie frame 110 can be acquired. As a result, the curvature information acquiring portion 20 can acquire the curvature information of the track on which the railcar 101 is located. The magnetic sensor 26 is electrically connected to the control portion 40 and transmits a signal regarding the curvature information to the control portion 40.

In the present embodiment, the index member 25 that is the detected portion is provided at the bolster beam 111, and the magnetic sensor 26 that is the detecting portion is provided at the bogie frame 110. However, the detected portion and the detecting portion may be provided at the bogie frame 110 and the bolster beam 111, respectively. Further, the curvature information acquiring portion 20 of the present embodiment includes the magnetic sensor 26 as the detecting portion. However, a different sensor which can detect the position of the detected portion relative to the detecting portion may be included.

Operational Advantages, Etc.

As above, the coupler system 100 according to the embodiment includes: the coupler main body 10 attached to the longitudinal direction end of the carbody 102 of the railcar 101 so as to be rotatable in the yaw direction; the curvature information acquiring portion 20 configured to acquire the curvature information of the track on which the railcar 101 is located; the control portion 40 configured to determine the target rotation angle of the coupler main body 10 in accordance with the acquired curvature information and output the rotation signal regarding the determined target rotation angle; and the rotation angle changing portion 30 configured to rotate the coupler main body 10 to the target rotation angle based on the output rotation signal, when the railcar 101 is stopped or when the railcar 101 is traveling at the coupling speed, the control portion 40 outputting the rotation signal to start rotating the coupler main body 10.

Therefore, according to the coupler system 100 of the embodiment, the angle of the coupler main body 10 can be set to the rotation angle appropriate for the coupling, and the railcars 101 can be automatically coupled to each other. Since the railcars 101 can be automatically coupled to each other, it is unnecessary for a worker to get out of the railcar 101. Therefore, this is extremely effective especially for the railcar 101 which adopts a third rail system in which the overhead contact line is arranged at a low position. While the railcar 101 is traveling, force applied to the railcar 101 from the adjacent railcar is not directly transferred to the bogie 104 but is transferred through the carbody 102 to the bogie 104. Therefore, influences on the traveling performance of the railcar 101 are little, and the generation of the squeal and the like can be suppressed. Further, according to the embodiment, when not coupling the railcar 101, the coupler main body 10 does not rotate, so that unnecessary movements of the coupler main body 10 can be suppressed.

The curvature information acquiring portion 20 of the embodiment detects the relative rotation angle between the carbody 102 and the bogie frame 110 of the bogie 104 to acquire the curvature information of the track on which the railcar 101 is located. According to this configuration, the curvature information can be acquired by an extremely simple configuration. Further, even in a railyard where it is difficult to recognize the current position of the railcar 101 (i.e., for example, the landside spot signal is not provided), the curvature information can be surely acquired.

The curvature information acquiring portion 20 of Embodiment 1 includes: the detected portion (index member) 21 provided at one of the carbody 102 and the bogie frame 110; and the detecting portion (optical axis sensor) 22 provided at the other of the carbody 102 and the bogie frame 110, and the curvature information acquiring portion 20 of Embodiment 1 detects the relative rotation angle between the carbody 102 and the bogie frame 110 by causing the detecting portion 22 to detect the position of the detected portion 21 relative to the detecting portion 22. Since the coupler system 100 configured as above is adoptable regardless of whether or not the bogie 104 is a bolsterless bogie, the versatility of the coupler system 100 is high.

On the other hand, in Embodiment 2, the bogie 104 includes the bolster beam 111 configured to operate interlockingly with the carbody 102 and rotates relative to the bogie frame 110, wherein: the curvature information acquiring portion 20 includes the detected portion (index member) 25 provided at one of the bolster beam 111 and the bogie frame 110 and the detecting portion (magnetic sensor) 26 provided at the other of the bolster beam 111 and the bogie frame 110; and the curvature information acquiring portion 20 detects the relative rotation angle between the carbody 102 and the bogie frame 110 by causing the detecting portion 26 to detect the position of the detected portion 25 relative to the detecting portion 26. According to the coupler system 100 configured as above, it is unnecessary to attach the detecting portion 26 or the detected portion 25 to the carbody 102, and the system can be configured in the bogie 104. Therefore, setting and the like can be easily performed, and detection accuracy can be improved.

Embodiment 1 is configured such that: the detected portion 21 is provided at a car longitudinal direction end portion of the bogie frame 11 and extends in the vertical direction; the detecting portion 22 includes the optical axis sensors 22 attached to the lower surface of the carbody 102 so as to be lined up in the car width direction, each of the optical axis sensors 22 including the light emitting portion 23 and the light receiving portion 24; and by causing the detected portion 21 to move between a group of the light emitting portions 23 and a group of the light receiving portions 24 in accordance with the rotation of the bogie frame 11, the curvature information acquiring portion 20 detects the position of the detected portion 21 relative to the optical axis sensors 22 to detect the relative rotation angle between the carbody 102 and the bogie frame 11. According to this configuration, the relative rotation angle between the carbody 102 and the bogie frame 11 can be detected without using a special sensor.

The rotation angle changing portion 30 of the embodiment includes the air cylinder 31 connecting the coupler main body 10 and the carbody 102, and the rotation angle changing portion 30 of the embodiment causes the air cylinder 31 to expand or contract based on the rotation signal to rotate the coupler main body 10 to the target rotation angle. According to this configuration including the air cylinder 31, by removing the air from the air cylinder 31, the coupler main body 10 can be easily set to the free state. By setting the coupler main body 10 to the free state, the influences on the traveling performance of the railcar 101 by the coupling can be further reduced.

The curvature information acquiring portion 20, the control portion 40, and the adjusting valve portion 32 according to the embodiment can operate by the electric power supplied from the battery 105 mounted on the railcar 101. With this, the coupler main body 10 is rotated to the target rotation angle. Therefore, even in a case where the electric power cannot be collected from the overhead contact line because of some reasons when coupling the railcar 101 at the time of the failure, the coupler main body 10 can be surely rotated to the target rotation angle.

The foregoing has explained the embodiments according to the present invention in reference to the drawings. However, the specific configuration is not limited to these embodiments, and design modifications and the like may be made within the scope of the present invention.

INDUSTRIAL APPLICABILITY

The coupler system according to the present invention can automatically perform coupling even when a railcar is located on a curved track, and can suppress influences on traveling performance of the railcar. Therefore, the coupler system according to the present invention is useful in a technical field of railcars.

REFERENCE SIGNS LIST

10 coupler main body
11 coupling mechanism

12 insertion projection
13 insertion hole
20 curvature information acquiring portion
21 index member (detected portion)
22 optical axis sensor (detecting portion)
25 index member (detected portion)
26 magnetic sensor (detecting portion)
30 rotation angle changing portion
31 air cylinder
32 valve adjusting portion
33 air supply portion
40 control portion
100 coupler system
101 railcar
102 carbody
104 bogie
105 battery
106 support shaft
107 speed sensor
108 mode setting portion
110 bogie frame
111 bolster beam

The invention claimed is:

1. A coupler system of a railcar, the coupler system comprising:

a coupler main body attached to a longitudinal direction end of a carbody of the railcar so as to be rotatable in a yaw direction;

a curvature information acquiring portion configured to acquire curvature information of a track, the railcar being located on the track;

a speed sensor configured to measure a speed of travel of the railcar;

a control portion configured to:

determine a target rotation angle of the coupler main body in accordance with the acquired curvature information;

determine whether the railcar is stopped or traveling at a predetermined coupling speed based on a speed signal from the speed sensor indicating the speed of travel of the railcar; and in response to determining that the railcar is stopped Of the railcar is traveling at the coupling speed, output a rotation signal regarding the determined target rotation angle in order to start rotating the coupler main body; and a rotation angle changing portion configured to rotate the coupler main body to the target rotation angle based on the output rotation signal.

2. The coupler system according to claim 1, wherein the curvature information acquiring portion detects a relative rotation angle between the carbody and a bogie frame of a bogie to acquire the curvature information of the track.

3. The coupler system according to claim 2, wherein:

the curvature information acquiring portion includes a detected portion provided at one of the carbody and the bogie frame, and a detecting portion provided at another one of the carbody and the bogie frame; and the curvature information acquiring portion detects the relative rotation angle between the carbody and the bogie frame by causing the detecting portion to detect a position of the detected portion relative to the detecting portion.

4. The coupler system according to claim 2, wherein:

the bogie includes a bolster beam configured to operate interlockingly with the carbody and rotate relative to the bogie frame;

the curvature information acquiring portion includes a detected portion provided at one of the bolster beam and the bogie frame, and a detecting portion provided at another one of the bolster beam and the bogie frame; and the curvature information acquiring portion detects the relative rotation angle between the carbody and the bogie frame by causing the detecting portion to detect a position of the detected portion relative to the detecting portion.

5. The coupler system according to claim 3, wherein:

the detected portion is provided at a car longitudinal direction end portion of the bogie frame, the detected portion extending in a vertical direction of the carbody;

the detecting portion includes optical axis sensors attached to a lower surface of the carbody so as to be lined up in a car width direction, each of the optical axis sensors including a light emitting portion and a light receiving portion; and the curvature information acquiring portion detects the position of the detected portion relative to the optical axis sensors in order to determine the relative rotation angle between the carbody and the bogie frame, by causing the detected portion to move between a group of the light emitting portions and a group of the light receiving portions in accordance with the rotation of the bogie frame.

6. The coupler system according to claim 1, wherein:

the rotation angle changing portion includes an actuator connecting the coupler main body and the carbody; and the rotation angle changing portion causes the actuator to expand or contract based on the rotation signal to rotate the coupler main body to the target rotation angle.

7. The coupler system according to claim 1, wherein the rotation angle changing portion receives electric power from a battery, which is mounted on the railcar, to rotate the coupler main body to the target rotation angle.

8. A railcar comprising the coupler system according to claim 1.

* * * * *